US006332566B1

(12) United States Patent
Rota

(10) Patent No.: US 6,332,566 B1
(45) Date of Patent: Dec. 25, 2001

(54) RUCKSACK WITH BACKREST PROVIDED WITH ELASTIC STRIP

(75) Inventor: Paolo Rota, Turin (IT)

(73) Assignee: Invicta Brand SpA, Turin (IT)

( * ) Notice: Subject to any disclaimer, the term of this patent is extended or adjusted under 35 U.S.C. 154(b) by 0 days.

(21) Appl. No.: 09/655,766

(22) Filed: Sep. 5, 2000

(30) Foreign Application Priority Data

Sep. 3, 1999 (IT) ..... TO99A0740

(51) Int. Cl.[7] ..... A45F 3/04
(52) U.S. Cl. ..... 224/628; 224/153; 224/630
(58) Field of Search ..... 224/628, 630, 224/153

(56) References Cited

U.S. PATENT DOCUMENTS 5,891,640 * 4/1999 Thompson ..... 224/630

* cited by examiner

*Primary Examiner*—Gregory M. Vidovich
*Assistant Examiner*—Maerena W. Brevard
(74) *Attorney, Agent, or Firm*—Sughrue Mion, PLLC

(57) ABSTRACT

Associated to the backrest of a rucksack is an elastic strip set in the vertical direction of the backrest, the strip lying in a plane parallel to the backrest and having its ends operatively connected to the backrest in such a way that a deformation due to bending of the backrest according to the dorsal arch of the user generates an elastic reaction of the aforesaid strip tending to cause the backrest to return into the undeformed condition so as to favor correct resting of the rucksack on the spine of the user.

8 Claims, 3 Drawing Sheets

1
12
2
6

RUCKSACK WITH BACKREST PROVIDED WITH ELASTIC STRIP

The present invention relates to rucksacks of the general type comprising a body defined by a padded backrest to the perimeter of which is secured a bag portion and a pair of shoulder straps, each strap having its ends connected to the bottom part and to the top part of the body of the rucksack in the vicinity of the backrest. The invention can be applied to any type of rucksack, but is particularly designed for application to the so-called school rucksacks.

The purpose of the present invention is to provide a rucksack of the type specified above that will guarantee or in any case will favour as much as possible a correct posture of the user, and in particular correct resting of the rucksack on the user's spine, with particular regard to the possibility of the load carried in the rucksack being relatively heavy, as, for example, frequently occurs in the case of rucksacks for school children.

With a view to achieving this purpose, the subject of the invention is a rucksack of the type indicated above, the main characteristic of which lies in the fact that, associated to the backrest of the rucksack are elastic-strip means comprising at least one elastic lamina or strip lying in a plane parallel to the backrest and having its ends operatively connected to the backrest in such a way that a deformation due to bending of the backrest according to the dorsal arch of the user generates an elastic reaction of the aforesaid strip means tending to cause the backrest to return to the undeformed condition.

In a preferred embodiment of the rucksack according to the invention, the aforesaid elastic strip has a first end secured to the backrest, and a second end, which is also secured to the backrest but with the possibility of relative displacement in the vertical direction of the backrest. For instance, in a specific embodiment the aforesaid second end of the elastic strip is engaged in a loop on the backrest.

Thanks to the above characteristics, the rucksack according to the invention can advantageously have the function of elastic stiffening for it to rest correctly on the spine of the user, this advantage being absent in the rucksacks made up to now.

Further characteristics and advantages of the present invention will emerge from the ensuing description, with reference to the attached drawings, which are provided purely to furnish a non-limiting example, and in which.

Figure 1:
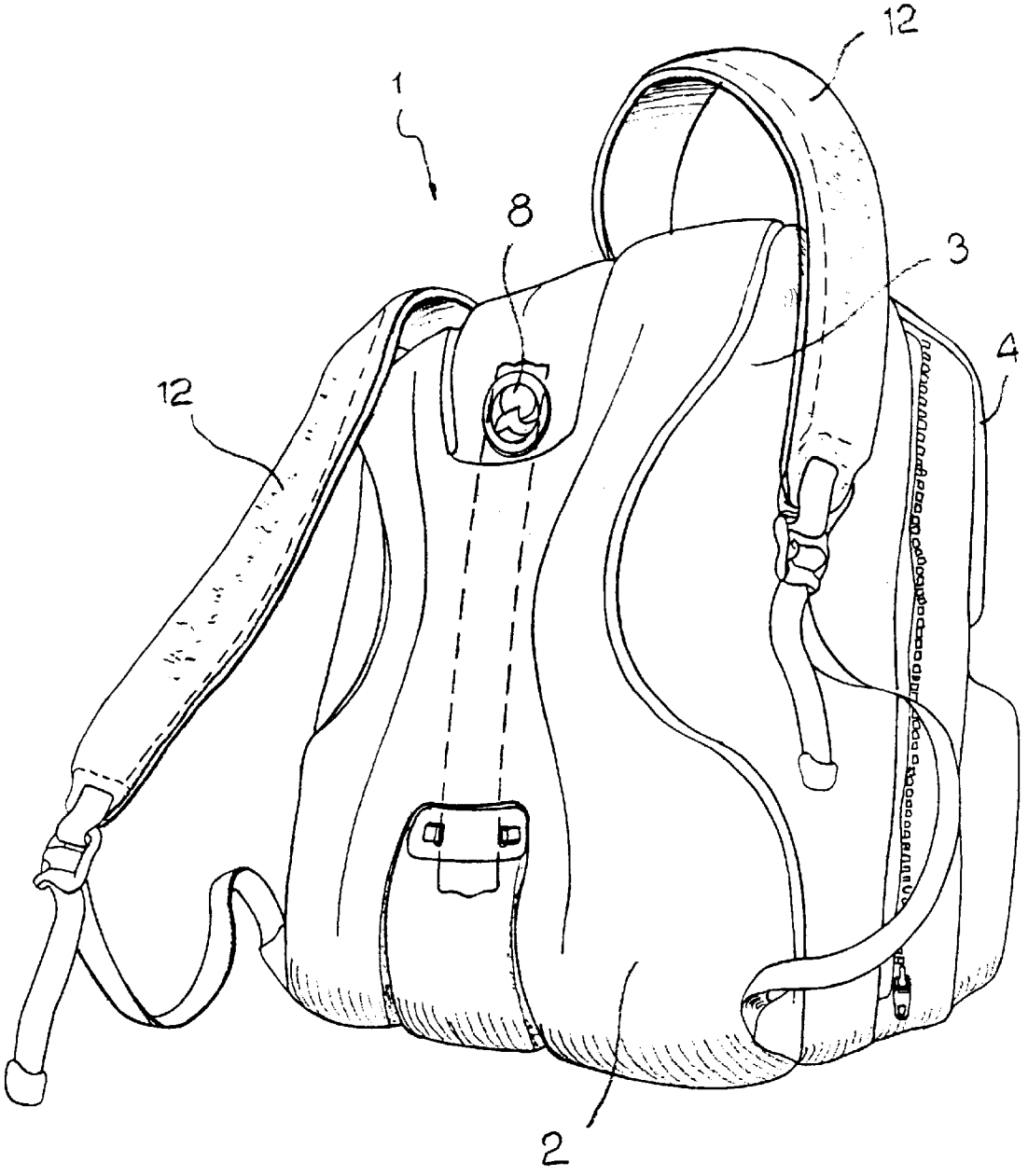
FIG. 1 is a perspective view of a preferred embodiment of the rucksack according to the invention.

With reference to the drawings, the number 1 designates, as a whole, a rucksack for school use, comprising a backrest 2 made up of a panel of plasticfoam material provided with a lining. The technology with which the backrest 2 is produced is not illustrated in detail herein since it is widely known and in itself does not fall within the scope of the invention. Again according to conventional techniques, along the perimeter of the backrest 2 a fabric bag 3 is sown which defines, together with the backrest 2, the body of the rucksack and is provided with an openable covering flap 4 for access to the inside of the rucksack. Again according to conventional techniques, the backrest 2 is made out of a single piece with a bottom padded portion 5 (see FIG. 3).

Figure 4:
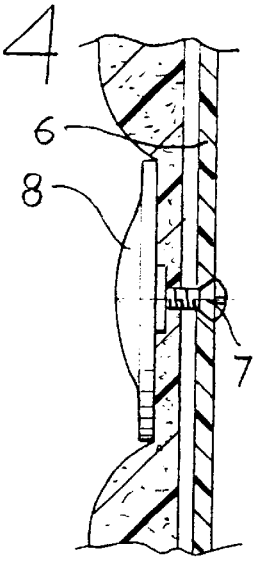
FIGS. 4 and 5 are sections according to the lines IV—IV and V—V of FIG. 3.
Figure 5:
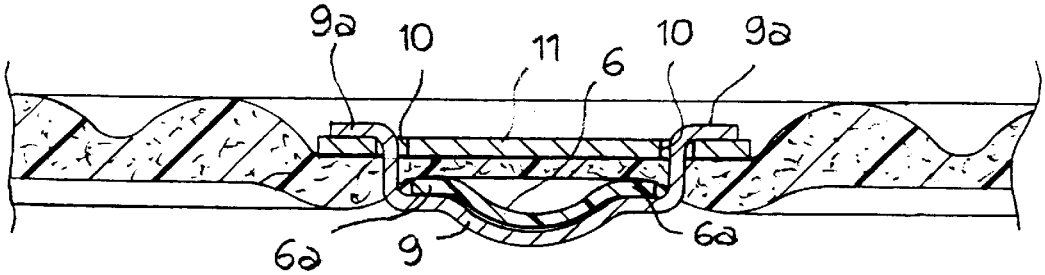

According to the invention, on the inside of the backrest 2 an elastic laminar strip 6 is set, which extends in the vertical direction of the backrest 2 with its plane parallel to the plane of the backrest. In the case of the example illustrated, the strip 6 consists of a single element of plastic material, for example nylon, having a top end secured, by means of a screw 7, to a circular plate 8 made of plastic material, the said circular plate 8 being set on the outside of the backrest 2 and being advantageously usable for bearing on its top a trade mark or the like (see FIGS. 1 and 4). The bottom end of the strip 6 engages in a sliding way with a loop 9 carried by the backrest 2 on the inner side of the latter and having ends 9*a* which engage through slits 10 made in a counterplate 11 set on the outside of the backrest (see FIG. 5). of course, the way in which the loop 9 is fixed to the backrest 2 may also be altogether different from the one illustrated in FIG. 5 simply to provide an example. As may be seen from FIG. 5, the strip 6 (and consequently also the loop 9) have a centrally arched profile and two flanges with coplanar plane ends 6*a*.

With reference again to FIG. 1, the rucksack 1 comprises a pair of shoulder straps 12, each having ends secured to the rucksack, one end of each strap being secured in the vicinity of the top part of the backrest 2, and the other end of each strap being secured in the vicinity of the bottom part of the backrest 2.

Figure 2:
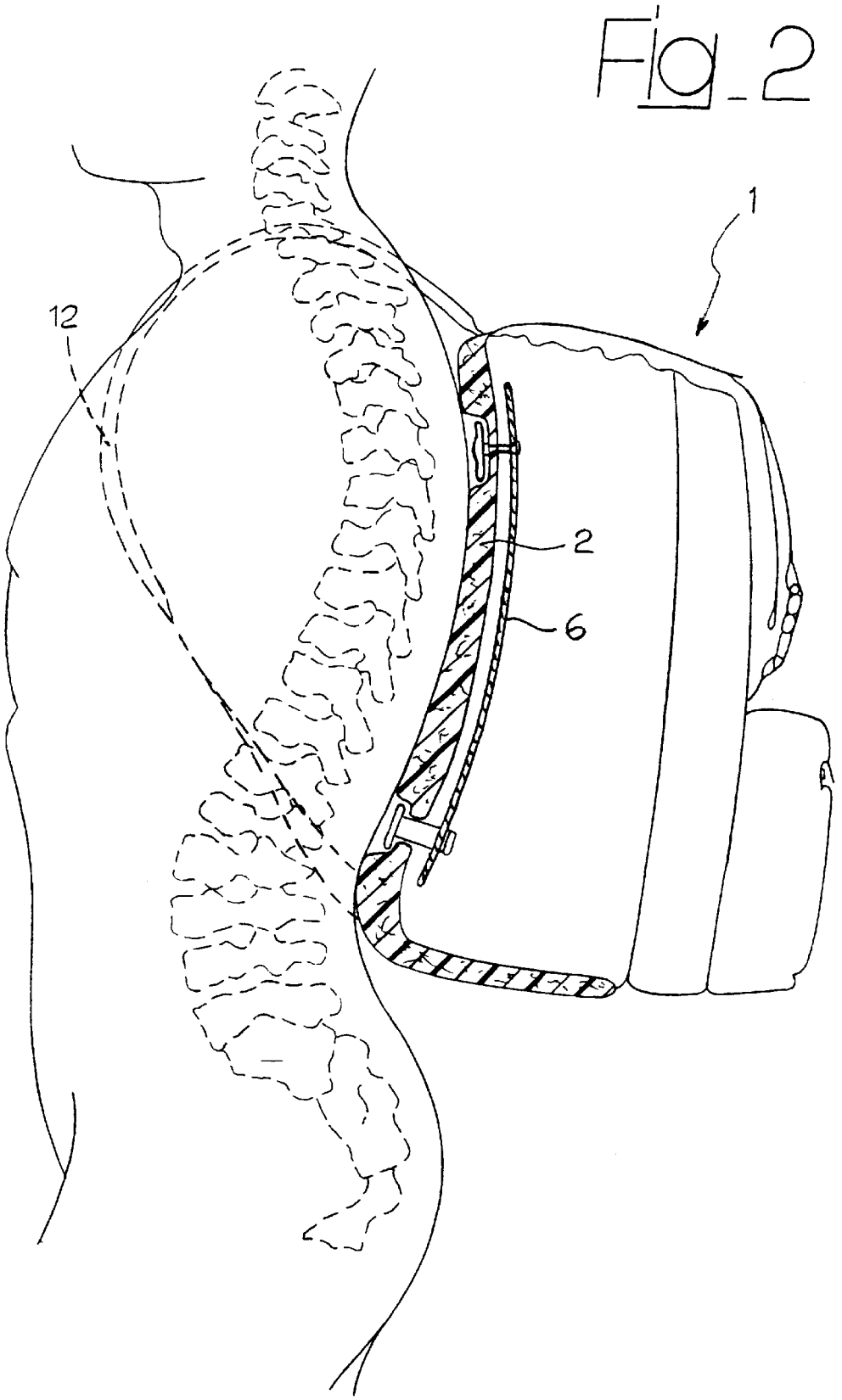
FIG. 2 is a sectional view of the rucksack of FIG. 1, in the condition of use.

As may be seen in FIG. 2, when the rucksack according to the invention is being used, i.e., with the user's arms through the shoulder straps 12, a bending deformation of the backrest 2, which causes a consequent bending deformation of the strip 6, is generated. Thanks to its elastic characteristics, the strip 6 consequently exerts an action of return of the backrest 2 towards the undeformed condition, which forces the user to maintain a correct posture. A possible incorrect posture of the user's spine would in fact lead to a greater bending deformation of the backrest 2 which is countered by the strip 6. The user is thus to some extent forced to maintain as far as possible a correct posture, with consequent reduction in the risk of damage to the back due to carrying a very heavy rucksack in an incorrect way.

Figure 3:
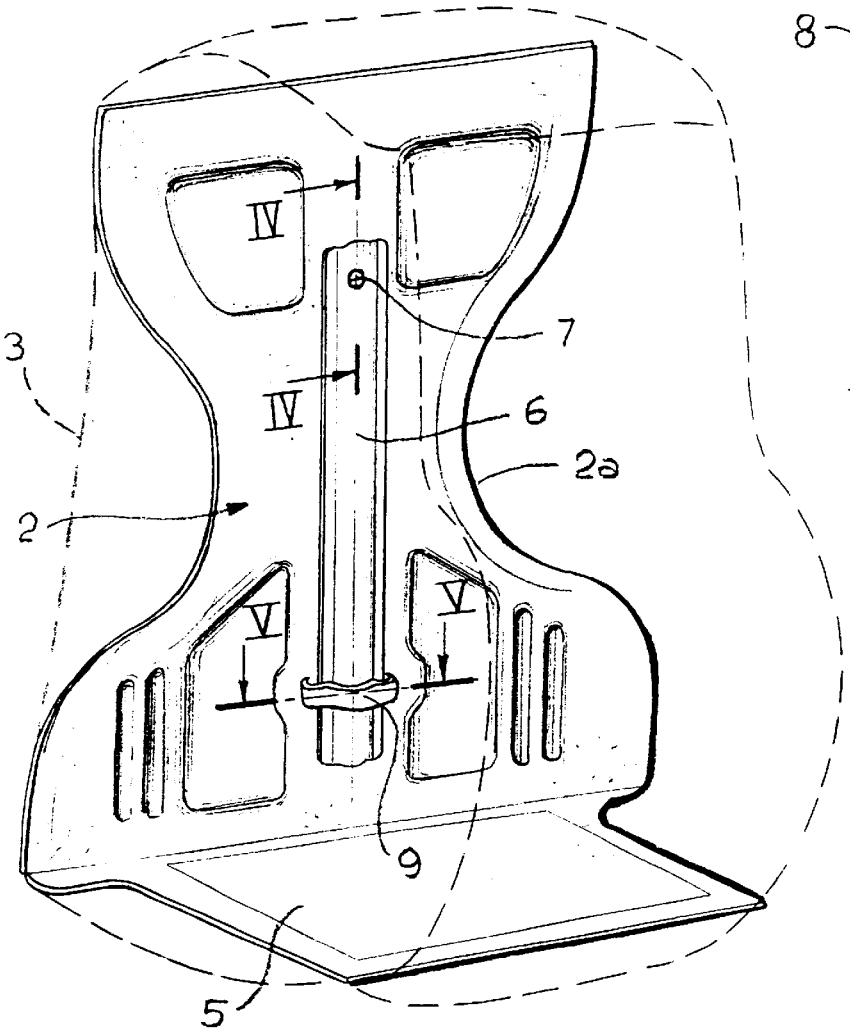
FIG. 3 is a perspective view of just the backrest of the rucksack, viewed from inside, with the remaining part of the rucksack indicated only by a dashed line.

As may be seen in FIGS. 1 and 3, the backrest of the rucksack according to the invention is moreover characterized in that it presents a shape like an hourglass, with a central portion 2*a* of reduced width which proves advantageous both from the aesthetic standpoint and from the ergonomic standpoint, in that the rucksack in this way has a more tapered and less sharp-edged overall shape.

Of course, without prejudice to the principle of the invention, the details of construction and the embodiments may vary widely with respect to what is described and illustrated herein purely for the purpose of providing an example, without thereby departing from the scope of the present invention.

In particular, the conformation and arrangement of the strip means may even be altogether different from the ones illustrated hereinbefore purely to provide an example. It would thus be possible to adopt two or more lamina-type springs arranged in a pack or in parallel according to the stiffening characteristics that it is intended to obtain.

What is claimed is:

1. A rucksack comprising a body defined by a padded backrest to the perimeter of which is secured a bag portion and a pair of shoulder straps, each strap having one end connected to the bottom part and one end to the top part of the body of the rucksack in the vicinity of the backrest, wherein associated to said backrest is an elastic assembly comprising at least one elastic lamina or strip set in the vertical direction of the backrest and lying in a plane parallel to the backrest and having its ends operatively connected to the backrest in such a way that a deformation due to bending of the backrest according to the dorsal arch of the user generates an elastic reaction of the aforesaid strip means tending to cause the backrest to return to the undeformed condition.

2. A rucksack according to claim 1, wherein said elastic strip has one first end secured to the backrest and one second end also secured to the backrest but with the possibility of relative displacement in the vertical direction of the backrest.

3. A rucksack according to claim 2, wherein said second end of the elastic strip is engaged inside a loop carried by the backrest.

4. A rucksack according to claim 2, wherein said first end of the elastic strip is rigidly connected to the backrest by means of a screw that engages a plate set on the outer face of the backrest and usable for bearing on it trade marks.

5. A rucksack according to claim 1, wherein the aforesaid backrest has a basically hourglass configuration, with a central part of reduced width.

6. A rucksack according to claim 2, wherein the aforesaid backrest has a basically hourglass configuration, with a central part of reduced width.

7. A rucksack according to claim 3, wherein the aforesaid backrest has a basically hourglass configuration, with a central part of reduced width.

8. A rucksack according to claim 4, wherein the aforesaid backrest has a basically hourglass configuration, with a central part of reduced width.

* * * * *

UNITED STATES PATENT AND TRADEMARK OFFICE

CERTIFICATE OF CORRECTION

PATENT NO. : 6,332,566 B1
DATED : December 25, 2001
INVENTOR(S) : Paolo Rota

It is certified that error appears in the above-identified patent and that said Letters Patent is hereby corrected as shown below:

Title page,
Item [73], please delete Assignee name "Invicta Brand Spa" insert -- Invicta Spa --

Signed and Sealed this

Twenty-sixth Day of November, 2002

*Attest:*

*Attesting Officer*

JAMES E. ROGAN
*Director of the United States Patent and Trademark Office*